US006416297B1

(12) United States Patent
Kawaguchi et al.

(10) Patent No.: US 6,416,297 B1
(45) Date of Patent: Jul. 9, 2002

(54) STOPPING MEANS FOR PREVENTING MOVEMENT OF THE DRIVE SHAFT OF A VARIABLE DISPLACEMENT COMPRESSOR

(75) Inventors: Masahiro Kawaguchi; Keiichi Kato; Hajime Kurita; Hirotaka Kurakake; Satoshi Inaji, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/410,289

(22) Filed: Sep. 30, 1999

(30) Foreign Application Priority Data

Oct. 2, 1998 (JP) ..... 10-281589
Nov. 6, 1998 (JP) ..... 10-316004

(51) Int. Cl.[7] ..... F04B 1/26
(52) U.S. Cl. ..... 417/222.2; 417/365
(58) Field of Search ..... 417/222.2, 222.1, 417/365

(56) References Cited

U.S. PATENT DOCUMENTS 4,886,423 A * 12/1989 Iwanami et al. ..... 417/222.2
4,913,627 A * 4/1990 Terauchi ..... 417/222.2
4,948,343 A * 8/1990 Shimizu ..... 417/222.2
4,960,366 A * 10/1990 Higuchi ..... 417/222.2
5,299,918 A 4/1994 Teruo ..... 417/269
5,547,346 A * 8/1996 Kanzaki et al. ..... 417/222.2
5,897,298 A * 4/1999 Umemura ..... 417/222.2

FOREIGN PATENT DOCUMENTS

DE 198 03 863 A 9/1998
JP 07-180657 7/1995 ..... 417/222.2
JP 10-141223 5/1998 ..... 417/222.2

* cited by examiner

*Primary Examiner*—Charles G. Freay
*Assistant Examiner*—Michael K. Gray
(74) *Attorney, Agent, or Firm*—Morgan & Finnegan LLP

(57) ABSTRACT

A compressor that generates relatively little noise and prevents partial clutch engagement and gas leakage when the inclination of a cam plate is suddenly decreased by a great amount. The compressor includes a control valve that electrically controls the compressor displacement based on external information. The rear end of a drive shaft is supported by a shaft bore formed in a cylinder block. A stopper is located endwise of the drive shaft to limit axial movement of the drive shaft. The stopper may be very stiff spring or a rigid member.

23 Claims, 9 Drawing Sheets

STOPPING MEANS FOR PREVENTING MOVEMENT OF THE DRIVE SHAFT OF A VARIABLE DISPLACEMENT COMPRESSOR

BACKGROUND OF THE INVENTION

The present invention relates to a compressor used in an on-vehicle air conditioner. Particularly, the present invention pertains to a variable displacement compressor that varies its displacement based on environmental conditions.

FIG. 10 illustrates a typical variable displacement compressor. The compressor of FIG. 10 includes a front housing 201, a cylinder block 202 and a crank chamber 203, which is defined between the front housing 201 and the cylinder block 202. A drive shaft 204 extends and is rotatably supported in the crank chamber 203.

A cam plate, or swash plate 205, is supported by the drive shaft 204 in the crank chamber 203 by a lug plate 205*a*. The swash plate 205 rotates integrally with and is inclined relative to the drive shaft 204. The lug plate 205*a* is secured to the drive shaft 204 to transmit rotation of the drive shaft to the swash plate 205. The lug plate 205*a* is supported by a thrust bearing 205*b* located between the lug plate 205*a* and the front housing 201. A lip seal 203*a* is located between the circumferential surface of the front portion of the drive shaft 204 and the inner surface of an opening 201*a* of the front housing 201 to seal the crank chamber 203.

Cylinder bores 202*a* are formed in the cylinder block 202. A piston 206 is reciprocally housed in each bore 202*a*. The pistons 206 are coupled to the swash plate 205. A rear housing 208 is secured to the cylinder block 202 by way of a valve plate 207. A suction chamber 209 and a discharge chamber 210 are defined in the rear housing 208. Refrigerant gas is drawn into the suction chamber 209 before being compressed by reciprocation of the pistons 206 in the cylinder bores 202*a*. The compressed gas is then conducted to the discharge chamber 210.

A shaft bore 202*b* is formed in the center of the cylinder block 202. The rear portion of the drive shaft 204 is fitted in the shaft bore 202*b*. A snap ring 211 is fixed to the rear portion of the shaft bore 202*b*. A thrust bearing 212 is located at the rear end of the drive shaft 204. A coil spring, or support spring 213, is located between the thrust bearing 212 and the snap ring 211. The support spring 213 urges the drive shaft 204 forward and compensates for dimensional errors of the parts. The support spring 213 also prevents the drive shaft 204 from chattering in the axial direction. The front side of the drive shaft 204 refers to the end connected to a drive source, or engine Eg, and the rear end of the drive shaft 204 refers to the opposite end.

The discharge chamber 210 and the crank chamber 203 are connected by a supply passage 214. A control valve 215 is located in the supply passage 214 to adjust the flow rate of refrigerant gas. The control valve 215, which is an electromagnetic valve, controls the size of an opening between a valve body 216 and a valve hole 217 based on external information such as the temperature of an evaporator connected to the compressor, the temperature of the passenger compartment, a target value of the compartment temperature and the speed of the engine Eg. Accordingly, the difference between the pressure Pc in the crank chamber 203 and the pressure in the cylinder bores 202*a* is changed. The inclination of the swash plate 205 is changed in accordance with the changed pressure difference. The abutment of the swash plate 205 against a limit member or, stop ring 218, prevents the inclination of the swash plate 205 from being less than a predetermined minimum inclination.

An electromagnetic clutch 219 is attached to the front end of the drive shaft 204 to selectively transmit the force of the engine Eg. The clutch 219 includes an armature 220 and a pulley 221. The armature 220 is secured to the drive shaft 204 and includes a surface perpendicular to the axis of the drive shaft 204. The pulley 221 is coupled to the engine Eg. The armature 220 is located in front of the pulley 221. A core 222 is located next to the pulley 221. The armature 220 is coupled to and separated from the pulley 221 by exciting and de-exciting the core 222.

When the target compartment temperature is significantly changed in a short time, or when the engine speed is suddenly increased, the compressor displacement is minimized. At this time, the control valve 215 abruptly widens the opening between the valve body 216 and the valve hole 217 based on the external information. Accordingly, highly pressurized refrigerant gas in the discharge chamber 210 is suddenly conducted to the crank chamber 203, which quickly increases the pressure Pc of the crank chamber 203. In this case, the pressure difference between the crank chamber 203 and the cylinder bores 202*a* with the pistons 206 in between is suddenly increased. A sudden change of pressure dramatically decreases the inclination of the swash plate 205, which presses the swash plate 205 against the ring 218.

The thrust load acting on the drive shaft 204 will now be described. The force F acting on the drive shaft 204 is expressed by the following equation (1).

$$F = Fgh - Fsp - \sum_{i=1}^{N} S(Pb(i) - Pc) \tag{1}$$

Fgh represents the force that the clutch 219 applies to the drive shaft. Fsp represents a load at the rear end of the drive shaft 204. N represents the number of the cylinder bores 202*a*. S represents the cross-sectional area of each cylinder bore 202*a*. Pb(i) represents the pressure in each cylinder bore 202*a*. Pc represents the pressure of the crank chamber 203. The equation (1) can be approximated by an equation (2) below, which has been obtained through experiments.

$$F = Fgh - Fsp - \frac{SN}{7}(3Pd + 4Ps - 7Pc) \tag{2}$$

Ps represents the pressure of the suction chamber 209 (suction pressure). Pd represents the pressure of the discharge chamber 210.

When the swash plate 205 is pressed against the stop ring 218, the equation (2), or the value F, is greater than zero (F>0). In other words, the drive shaft 204 receives a rearward force. The rearward force acts as a compression load and is transmitted to the support spring 213 via the thrust bearing 212 thereby compressing the spring 213.

However, since the spring 213 is a coil spring, a change of the axial dimension of the spring 213, as shown in FIG. 4, does not significantly increases the force of the spring 213. Therefore, the support spring 213 allows the drive shaft 204 to move rearward. When the drive shaft 204 is moved rearward, the stroke range of the pistons 206, which are coupled to the drive shaft 204 through the swash plate 205, is moved rearward. Accordingly, the top dead center position of each piston 206 is moved rearward.

When each piston 206 is at the top dead center, a predetermined space exists between the piston 206 and the valve plate 207. The space prevents the pistons 206 from interfering with the valve plate 207.

However, when the drive shaft 204 is moved rearward such that the top dead center of each piston 206 is moved by a distance greater than the axial dimension of the space between the top dead center and the valve plate 207, the pistons 206 collide with the valve plate 207. The collision generates noise and vibration and damages the piston 206 and the valve plate 207. In other words, the life of the compressor is shortened.

When the drive shaft 204 is displaced rearward, the armature 220, which is secured to the drive shaft 204, is also moved rearward, or brought closer to the pulley 221, which is coupled to the engine Eg. If the core 222 is de-excited in this state, the armature 220 may not be moved to a normal disconnection position but may contact the pulley 221. This creates noise and heat in the clutch 219 and reduces the life of the clutch 219.

Further, when the drive shaft 204 is moved rearward, the lip seal 203*a* is displaced from a contact area, or predetermined position relative to the drive shaft 204. Sludge is often adhered to the drive shaft 204 at locations other than the location of the contact area. Thus, the lip seal 203*a* may be moved onto sludge, which degrades the lip seal 203*a* and causes gas to leak from the crank chamber 203.

If the force of the spring 213 acting on the shaft 204 is increased to prevent axial movement of the drive shaft 204, an increased force acts on the thrust bearings 205*b*, 212. Therefore, the bearings 205*b*, 212 are worn in a relatively short time, which reduces the life of the compressor. Also, the force required for rotating the drive shaft 204 is increased, which lowers the compression efficiency of the compressor.

SUMMARY OF THE INVENTION

Accordingly, it is an objective of the present invention to provide a variable displacement compressor that prevents noise, vibration, gas leak and guarantees a secure disconnection of a clutch when the cam plate inclination is suddenly decreased based on external information.

To achieve the foregoing and other objectives and in accordance with the purpose of the present invention, a variable displacement compressor is provided. The compressor includes a crank chamber, a drive shaft rotatably supported by and extending through the crank chamber and a cam plate supported by the drive shaft in the crank chamber. The inclination of the cam plate is changeable. The compressor also includes a piston coupled to the cam plate. The piston is reciprocated by a stroke in accordance with the inclination of the cam plate. The compressor further includes a valve plate, a control valve, a limit member and a stopper. The valve plate is located at the opposite side of the piston from the crank chamber. The control valve controls the difference between the pressure in the crank chamber and the pressure at the valve plate, which act on the piston, thereby changing the inclination of the cam plate to control the displacement of the compressor. The limit member is attached to the drive shaft and is located next to the cam plate. The limit member defines the minimum inclination of the cam plate. The stopper prevents the drive shaft from moving toward the valve plate by a significant amount when the cam plate contacts the limit member. The stopper includes the valve plate and rigid material lying between the valve plate and the drive shaft.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A variable displacement compressor Cp of a single-headed piston type according to first embodiment will now be described with reference to FIGS. 1 to 4.

Figure 1:
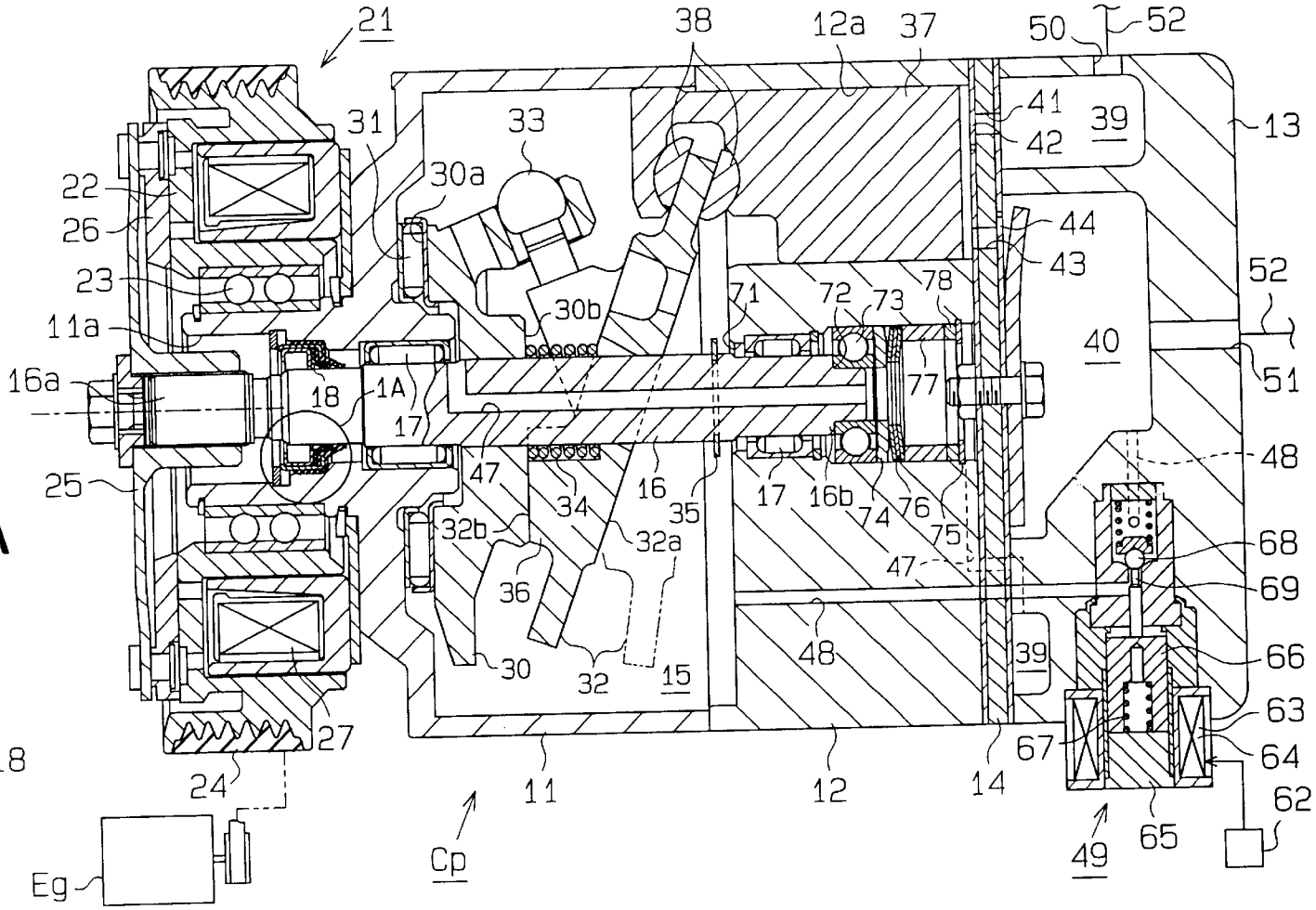
FIG. 1 is a cross-sectional view illustrating a variable displacement compressor according to a first embodiment of the present invention.
Figure 1A:
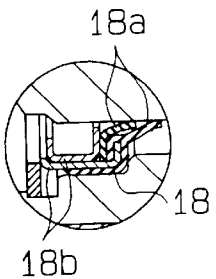
FIG. 1A is an enlargement of the encircled portion of FIG. 1.

As shown in FIG. 1, a front housing 11 is secured to the front end face of a cylinder block 12. A rear housing 13 is secured to the rear end face of the cylinder block 12, and a valve plate 14 is located between the rear housing 13 and the cylinder block 12. The front housing 11, the cylinder block 12 and the rear housing 13 form a compressor housing. A crank chamber 15 is defined by the inner walls of the front housing 11 and the front end face of the cylinder block 12.

A drive shaft 16 is rotatably supported by radial bearings 17 in the front housing 11 and the cylinder block 12. A front portion 16*a* of the drive shaft 16 protrudes from an opening 11*a* of the front housing 11. A lip seal 18 is located between the drive shaft 16 and the inner wall of the front housing opening 11*a* to seal the crank chamber 15.

The lip seal 18 includes lip rings 18*a* and metal backup rings 18*b*, which are alternately arranged. The lip rings 18*a* are made of synthetic rubber or fluorocarbon resin. The inner surface of the inner lip ring 18*a* contacts a predetermined surface position, or contact area, of the drive shaft 16.

An electromagnetic clutch 21 is located between a power source, or engine Eg, and the front portion 16*a* of the drive shaft 16. The front housing 11 has a cylindrical wall, or boss, extending forward. A pulley 22 is supported by the cylindrical wall with an angular bearing 23. The pulley 22 is coupled to an engine Eg by a belt 24. A hub 25 is coupled to the front portion 16*a* of the drive shaft 16. An armature 26 is secured to the peripheral portion of the hub 25. A core 27 is supported on the cylindrical wall of the front housing 11 and is located radially inside of the pulley 22.

A lug plate 30 is secured to the drive shaft 16 in the crank chamber 15. A thrust bearing 31 is located between the front face 30*a* of the lug plate 30 and the inner wall of the front housing 11 to receive forward thrust load acting on the lug plate 30.

A cam plate, or swash plate 32, is supported on the drive shaft 16 to move along the surface of and incline relative to the axis of the drive shaft 16. A hinge mechanism 33 is located between the lug plate 30 and the swash plate 32. The hinge mechanism 33 allows the swash plate 32 to integrally rotate with the drive shaft 16. As the center of the swash plate 32 moves toward the cylinder block 12, the inclination of swash plate 32 decreases. As the center of the swash plate 32 moves toward the lug plate 30, the inclination of the swash plate 32 increases.

A coil spring 34 is located between the lug plate 30 and the swash plate 32 to decrease the inclination of the swash plate 32. The spring 34 urges the center of the swash plate 32 toward the cylinder block 12, or in a direction decreasing the inclination of the swash plate 32.

A limit member, or stop ring 35, is located on the drive shaft 16. The ring 35 contacts the rear surface 32*a* of the swash plate 32 to prevent the swash plate 32 from being moved beyond a predetermined minimum inclination (see FIG. 2). A projection 36 is formed on the front surface 32*b* of the swash plate 32. The projection 36 contacts the front surface 32*b* of the swash plate 32 to prevent the swash plate 32 from moving beyond a predetermined maximum inclination (see FIG. 1).

Cylinder bores 12*a* extend through the cylinder block 12 about the drive shaft 16. A single-headed piston 37 is accommodated in each cylinder bore 12*a*. The rear portion of each piston 37 is accommodated in the corresponding cylinder bore 12*a* and the front portion of each piston 37 is coupled to the swash plate 32 by means of shoes 38. Rotation of the swash plate 32 reciprocates each piston 37 in the corresponding cylinder bore 12*a*.

A suction chamber 40 is formed in the rear housing 13 and a discharge chamber 39 is defined in the rear housing 13 about the suction chamber 40. Suction ports 41 and discharge ports 43 are formed in the valve plate 14. A suction valve flap 42 is formed on each suction port 41 and a discharge valve flap 44 is formed on each discharge port 43. The suction ports 41 connect the suction chamber 39 to the cylinder bores 12*a* and are opened and closed by the suction valve flaps 42, respectively. The discharge ports 43 connect the cylinder bores 12*a* to the discharge chamber 40 and are opened and closed by the discharge valve flaps 44, respectively.

The crank chamber 15 is connected to the suction chamber 39 with a bleeding passage 47. The discharge chamber 40 is connected to the crank chamber 15 by a supply passage 48. A control valve 49 is located in the supply passage 48.

Figure 3:
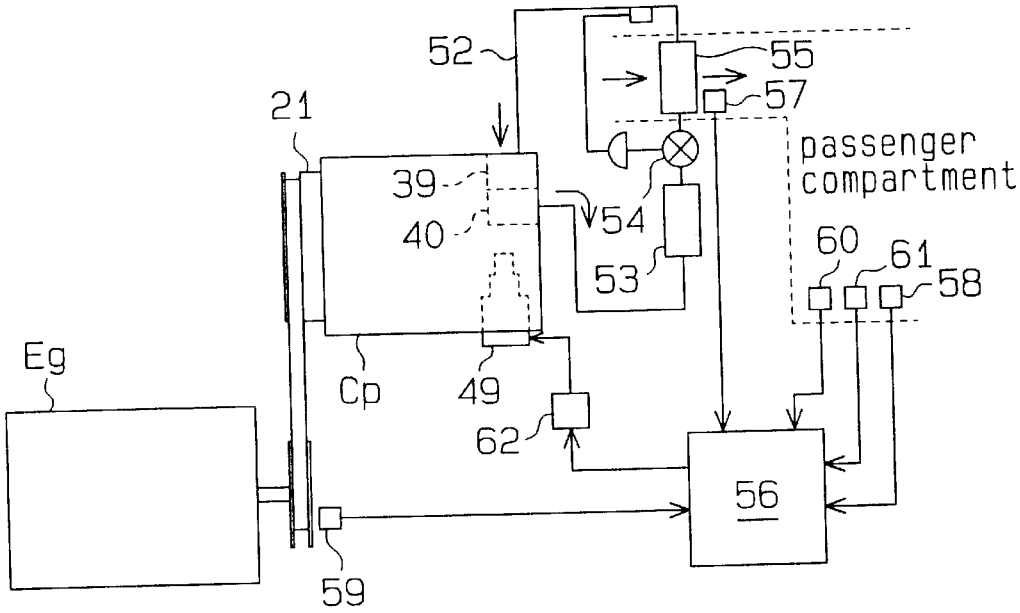
FIG. 3 is a schematic diagram illustrating devices connected to the compressor of FIG. 1.

As shown in FIGS. 1 and 3, an inlet 50 and an outlet 51 are formed in the rear housing 13. The inlet 50 is connected to the suction chamber 39, and the outlet 51 is connected to the discharge chamber 40. The inlet 50 is connected to the outlet 51 by an external refrigerant circuit 52. The refrigerant circuit 52 includes a condenser 53, an expansion valve 54 and an evaporator 55.

Devices connected to the compressor Cp, sensors for detecting the state of the devices and devices for setting target values are connected to a computer 56. The sensors include a temperature sensor 57 for detecting the temperature of the evaporator, a compartment temperature sensor 58 for detecting the temperature of the passenger compartment and an engine speed sensor 59. The setting devices include an air conditioner switch 60 for activating and deactivating the air conditioner and a temperature adjuster 61 for setting a target temperature of the passenger compartment.

The computer 56 receives various information including the temperature detected by the temperature sensor 57, the passenger compartment temperature detected by the temperature sensor 58, an ON/OFF signal from the starting switch 60, a target temperature set by the temperature adjuster 61 and the engine speed detected by the engine speed sensor 59. Based on this information, the computer 56 computes the value of a current supplied to a driver 62. Accordingly, the driver 62 sends a current having the computed value to a coil 64 of an electromagnetic actuator 63 in the control valve 49.

The actuator 63 includes the coil 64, a fixed core 65 and a plunger 66. A return spring 67 urges the plunger 66 away from the fixed core 65. The plunger 66 is coupled to a valve body 68. Current supplied to the coil 64 generates attractive force between the fixed core 65 and the plunger 66. The plunger 66 adjusts the position of the valve body 68, accordingly. In other words, the valve body 68 changes the size of a valve hole 69, which forms a part of the supply passage 48.

The devices connected to the compressor Cp and the characteristics of this embodiment will now be described.

Figure 2:
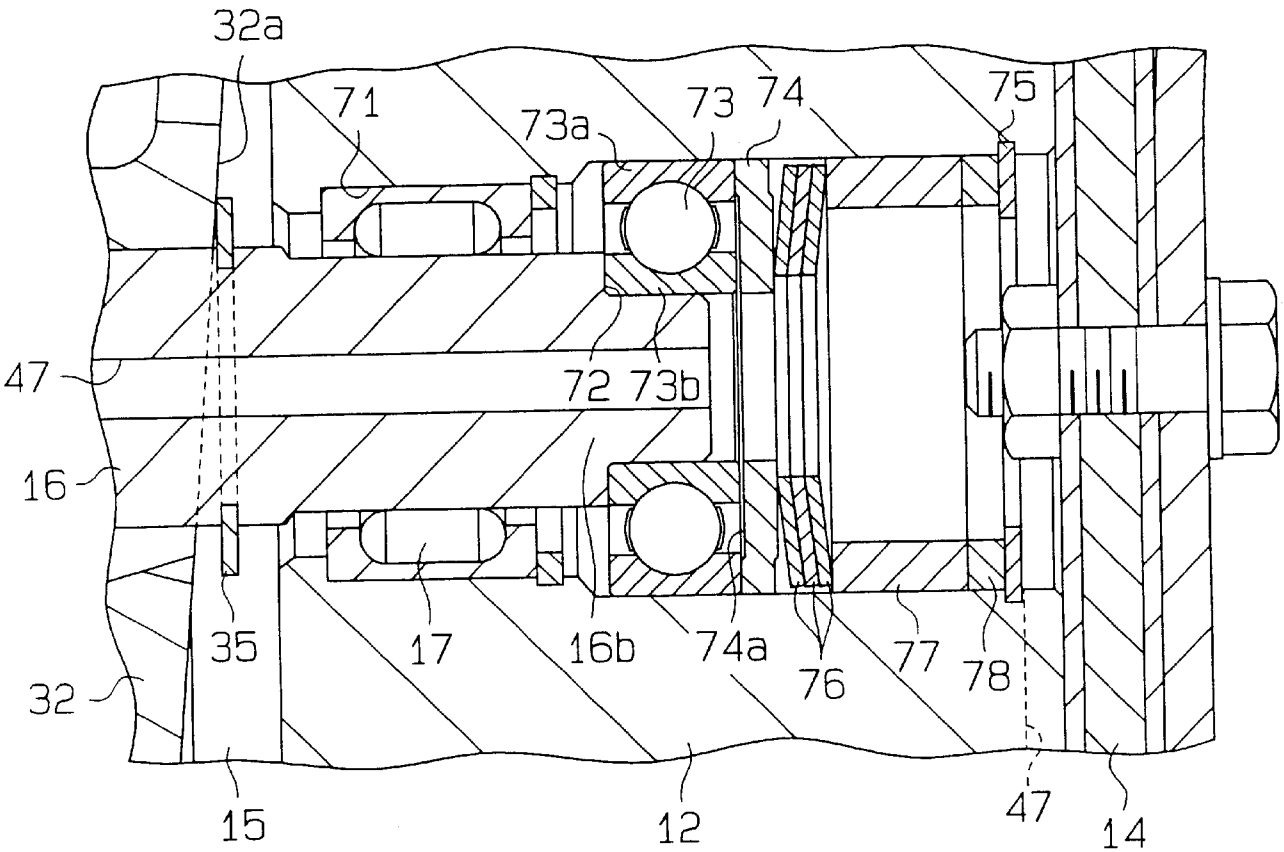
FIG. 2 is an enlarged partial cross-sectional view showing the rear portion of the drive shaft of FIG. 1.

As shown in FIGS. 1 and 2, an axial bore 71 is formed in the center of the cylinder block 12. The rear portion 16*b* of the drive shaft 16 is supported by the wall of the bore 71 through the rear radial bearing 17. A step 72 is formed in the shaft rear portion 16*b* of the shaft 16. An angular bearing 73 is fitted between the wall of the bore 71 and the step 72 to receive the thrust load acting on the drive shaft 16.

A spacer ring 74 is located adjacent to an outer race 73*a* of the angular bearing 73. An annular recess 74*a* is formed in the inner portion of the ring 74. The recess 74*a* prevents an inner race 73*b* of the angular bearing 73, which rotates integrally with the drive shaft 16, from interfering with the spacer ring 74.

A snap ring 75 is fitted to a rear portion of the wall of the axial bore 71. Truncated conical washers, or conical leaf springs 76, the number of which is three in this embodiment, a cylindrical spacer 77 and an annular adjuster, or shim 78, are located between the spacer ring 74 and the snap ring 75. The conical leaf springs 76, the spacer 77 and the shim 78 are arranged sequentially from the spacer ring 74.

The shim 78 is selected from various shims having different axial dimensions such that the shim 78 causes the conical leaf springs 76 to be deformed in such amount to generate a predetermined load. In other words, when assembling the compressor Cp, the load generated by the conical leaf springs 76 can be adjusted by selecting the shim 78 among shims having different axial dimensions. The predetermined load of the conical leaf springs 76 compensates for dimensional errors of parts and prevents the drive shaft 16 from being axially displaced. The conical leaf springs 76 urge the drive shaft 16 forward. Therefore, when the clutch 21 is not activated, a sufficient space exists between the armature 26 and the pulley 22.

The operation of the compressor Cp will now be described.

When the engine Eg is started and the core 27 is excited, the armature 26 is pressed against the pulley 22 against the force of the hub 25, which causes the clutch 21 to engage. In this state, the force of the engine Eg is transmitted to the drive shaft 16 through the belt 24 and the clutch 21. When the core 27 is de-excited, the armature 26 is separated from the pulley 22 by the force of the hub 25, which causes the clutch 21 to disengage. In this state, the force of the engine Eg is not transmitted to the drive shaft 16.

When transmitted to the drive shaft 16, the force of the engine Eg rotates the drive shaft 16 and the swash plate 32 together with the lug plate 30. Rotation of the swash plate 32 is converted into reciprocation of the pistons 37 by means of the shoes 38.

As each piston 37 moves from the top dead center to the bottom dead center, refrigerant gas in the suction chamber 39 is drawn into the corresponding cylinder bore 12a through the associated suction port 41 while causing the associated suction valve flap 42 to flex to an open position. As each piston 37 moves from the bottom dead center to the top dead center, the gas in the associated cylinder bore 12*a* is compressed to a predetermined pressure. The gas is then discharged to the discharge chamber 40 through the associated discharge port 43 while causing the associated discharge valve flap 44 to flex to an open position.

Changing of the displacement of the compressor Cp will now be described.

Refrigerant gas in the crank chamber 15 is constantly conducted to the suction chamber 39 through the bleeding passage 47 at a constant rate. On the other hand, the control valve 49 adjusts the opening amount of the valve hole 69 based on signals supplied thereto thereby controlling the flow rate of refrigerant gas supplied from the discharge chamber 40 to the crank chamber 15 through the supply passage 48. That is, the ratio of the amount of refrigerant gas discharged from the crank chamber 15 to the amount of refrigerant gas supplied to the crank chamber 15 is varied. Accordingly, the pressure Pc of the crank chamber 15 is altered. This changes the difference between the pressure acting on the pistons 37 from the crank chamber 15 and the pressure acting on the pistons 37 from the cylinder bores 12*a*. The altered pressure difference changes the inclination of the swash plate 32 thereby changing the stroke of the pistons 37, which adjusts the displacement of the compressor Cp.

When the need for cooling the passenger compartment and the thermal load of the evaporator 55 are great, the temperature sensor 57 detects a relatively high temperature. When receiving a high temperature detected by the sensor 57, the computer 56 compares this temperature with a frost forming temperature of the evaporator 55.

If the computer 56 judges that the detected temperature is higher than the frost forming temperature, the computer 56 commands the driver 62 to excite the solenoid 63 of the control valve 49. Accordingly, the driver 62 supplies a predetermined current to the coil 64, which generates a corresponding attractive force between the fixed core 65 and the plunger 66. The attractive force moves the plunger 66 toward the fixed core 65 against the force of the return spring 67. The valve body 68, which is coupled to the plunger 66, is moved in a direction closing the valve hole 69, which decreases the opening size of the supply passage 48.

As a result, the amount of refrigerant gas supplied from the discharge chamber 40 to the crank chamber 15 is decreased. Since refrigerant gas is constantly conducted to the suction chamber 39 from the crank chamber 15 through the bleeding passage 47, the pressure Pc of the crank chamber 15 is gradually lowered. Thus, the difference between the pressure Pc and the pressure in the cylinder bores 12*a* becomes small, which maximizes the inclination of the swash plate 32. Accordingly, the stroke of each piston 37 is increased and the compressor displacement is increased.

When the need for cooling of the passenger compartment and the thermal load of the evaporator 55 are small, the temperature sensor 57 detects a relatively low temperature. When receiving the temperature detected by the sensor 57 and the computer 56 judges that the detected temperature is substantially equal to the frost forming temperature, the computer 56 commands the driver 62 to de-excite the solenoid 63. Accordingly, the driver 62 stops the current to the coil 64, which eliminates the attractive force between the fixed core 65 and the plunger 66. Then, the plunger 66 is moved away from the fixed core 65 by the force of the return spring 69 and the valve body 68 is moved in a direction enlarging the opening of the valve hole 69. That is, the opening size of the supply passage 48 is increased.

Therefore, the amount of refrigerant gas supplied from the discharge chamber 40 to the crank chamber 15 is increased. When the amount of refrigerant gas supplied to the crank chamber 15 surpasses the amount of refrigerant gas discharged from the crank chamber 15 to the suction chamber 39 through the bleeding passage 47, the pressure Pc of the crank chamber 15 is gradually increased. This increases the difference of the crank chamber pressure Pc and the pressure in the cylinder bores 12*a*, which minimizes the inclination of the swash plate 32. Accordingly, the stroke of the pistons 37 and the compressor displacement are decreased.

The computer 56 uses other information such as the ON/OFF signal from the starting switch 60, the difference between a target temperature set by the temperature adjuster 61 and the compartment temperature detected by the compartment temperature sensor 58 and the engine speed detected by the engine speed sensor 59 to determine the value of current supplied to the coil 64. Accordingly, attractive force between the fixed core 65 and the plunger 66, which adjusts the opening between the valve body 68 and the valve hole 69, is adjusted. The changed attraction changes the amount of refrigerant gas supplied from the discharge chamber 40 to the crank chamber 15 and the crank chamber pressure Pc. Accordingly, the inclination of the swash plate 32 is altered. The altered swash plate inclination changes the stroke of the pistons 37, which varies the compressor displacement.

The temperature adjuster 61 is sometimes manipulated to significantly increase the target temperature. At this time, the computer 56 commands the driver 62 to de-excite the solenoid 63. Therefore, the opening amount of the valve hole 69 is suddenly increased, which results in an abrupt decrease of the inclination of the swash plate 32. In this case, the swash plate 32 is pressed against the ring 35, which applies a rearward thrust load to the drive shaft 16.

Also, when the engine speed detected by the engine speed sensor 59 is increased abruptly, the computer 56 commands the driver 62 to de-excite the solenoid 63 to minimize the compressor displacement thereby reducing the load acting on the engine Eg. In this case, the drive shaft 16 receives a rearward thrust load like when the target temperature is significantly increased.

Figure 4:
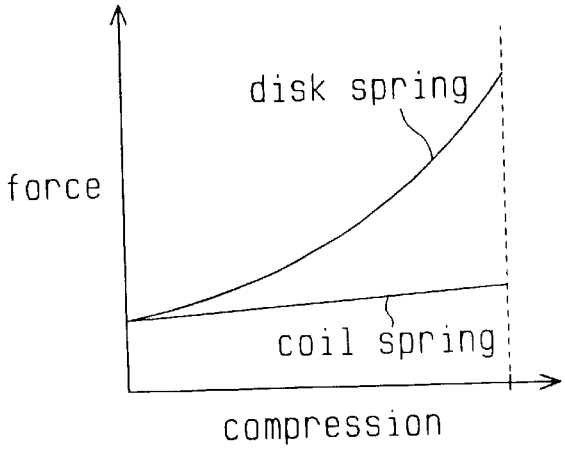
FIG. 4 is a graph showing the relationship between the rearward compression amount and the force of a coil spring and that of a disk spring.

The thrust load acting on the drive shaft 16 is transmitted to the conical leaf springs 76 through the angular bearing 73 and the spacer ring 74. As shown in the graph of FIG. 4, the force of each conical leaf spring 76 increases progressively as the compression amount is increased. That is, the conical leaf springs 76 are not compressed significantly when they receive a sudden and great compression load. Therefore, if a sudden rearward thrust acts on the drive shaft 16, the drive shaft 16 does not move rearward by a significant amount.

Accordingly, the embodiment of FIGS. 1 to 4 has the following advantages.

(A) As described above, the control valve 49 of the compressor Cp is controlled based on external information. The difference between the crank chamber pressure Pc and the pressure in the cylinder bores 12*a* is sometimes significantly changed in a short time, which presses the swash plate 32 against the ring 35 and applies rearward thrust to the drive shaft 16.

However, the compressor Cp has the conical leaf springs 76 located in the vicinity of the rear portion 16*b* of the drive shaft 16, which serve as a stopper. When the swash plate 32 is pressed against the stop ring 35, the conical leaf springs 76 prevent the drive shaft 16 from being displaced rearward. The conical leaf springs 76 generate a greater force when a greater thrust load acts on them. Thus, when the drive shaft 16 receives a thrust load, the conical leaf springs 76 effectively prevent the drive shaft 16 from moving axially rearward by a significant distance.

Each piston 37 is coupled to the drive shaft 16 by the lug plate 30, the hinge mechanism 33, the swash plate 32 and the shoes 38. The conical leaf springs 76 prevent the top dead center of each piston 37 from moving significantly rearward. Thus, each piston 37 is prevented from interfering with the valve plate 14. As a result, noise and vibration when the compressor Cp is operating at the minimum displacement are suppressed. Further, wearing of the pistons 37 and the valve plate 14 due to such contact is avoided, which extends the life of the compressor Cp.

The lip seal 18 is located between the drive shaft 16 and the opening 11*a* to seal the crank chamber 15. Since significant rearward movement of the drive shaft 16 is prevented as described above, the lip seal 18 is not significantly displaced relative to the drive shaft 16.

Thus, the lip rings 18*a* of the seal 18 are not significantly displaced from the contact area on the drive shaft 16. Therefore, the lip ring 18*a* is not located over sludge adhered on the drive shaft 16 outside of the contact area. Accordingly, premature deterioration of the lip seal 18 and gas leak are prevented, which extends the life of the compressor Cp.

(B) The shim 78 is selected from shims having different axial dimensions, which allows the initial load generated by the conical leaf springs 76 to be adjusted.

In other words, the initial load of the conical leaf springs 76 can be easily adjusted. Thus, load acting on the thrust bearing 31 and the angular bearing 73 is optimally adjusted, which prevents the bearings 31, 73 from being prematurely worn. Also, the shim 78 adjusts force required to rotate the drive shaft 16, which allows this force to be limited. Accordingly, the compression efficiency and the durability of the compressor Cp are improved.

(C) The power of the engine Eg is selectively transmitted to the drive shaft 16 by the pulley 22 and the armature 26, which are selectively engaged. The current to the core 27 is sometimes stopped for disengaging the clutch 21 while the swash plate 32 is at the minimum inclination position. If the drive shaft 16 were axially displaced in the rearward direction, the space between the pulley 22 and the armature 26 might be too narrow.

However, the conical leaf springs 76 prevent the drive shaft 16 from moving rearward, or in a direction causing the armature 26 to contact the pulley 22. Therefore, when the clutch 21 is disengaged, the size of the space between the pulley 22 and the armature 26 is maintained, that is, the armature 26 does not contact the pulley 22. Thus, the pulley 22 does not slide on the armature 26, which guarantees positive disconnection of the clutch 21 and prevents noise and heat.

(D) The opening of the control valve 49 is electrically adjusted based on external information such as the compartment temperature, a target value of the compartment temperature, the temperature of the evaporator 55 of the refrigerant circuit 55 and the engine speed.

Therefore, even if the swash plate 32 is at the minimum inclination position, the control valve 49 may be kept fully open in accordance with the external information. Such cases includes when the engine speed is suddenly increased with substantially no need for cooling in the passenger compartment. In this case, the crank chamber pressure Pc is increased excessively and the swash plate 32 is strongly pressed against the stop ring 35, which applies a strong rearward thrust load to the drive shaft 16.

However, in the compressor of FIGS. 1 to 4, the drive shaft 16 is prevented from moving rearward as described above. Therefore, even if the crank chamber pressure Pc is dramatically increased, the drive shaft 16 is not moved rearward by a significant amount. Therefore, the structure of FIGS. 1 to 4 prevents contact between the pistons 37 and the valve plate 14, relative movement between the drive shaft 16 and the lip seal 18, noise and vibration due to incomplete disengagement of the clutch 21 and wearing of and damage to the parts around the drive shaft 16.

A second embodiment of the present invention will hereafter be described. The differences from the first embodiment will mainly be discussed below.

Figure 5:
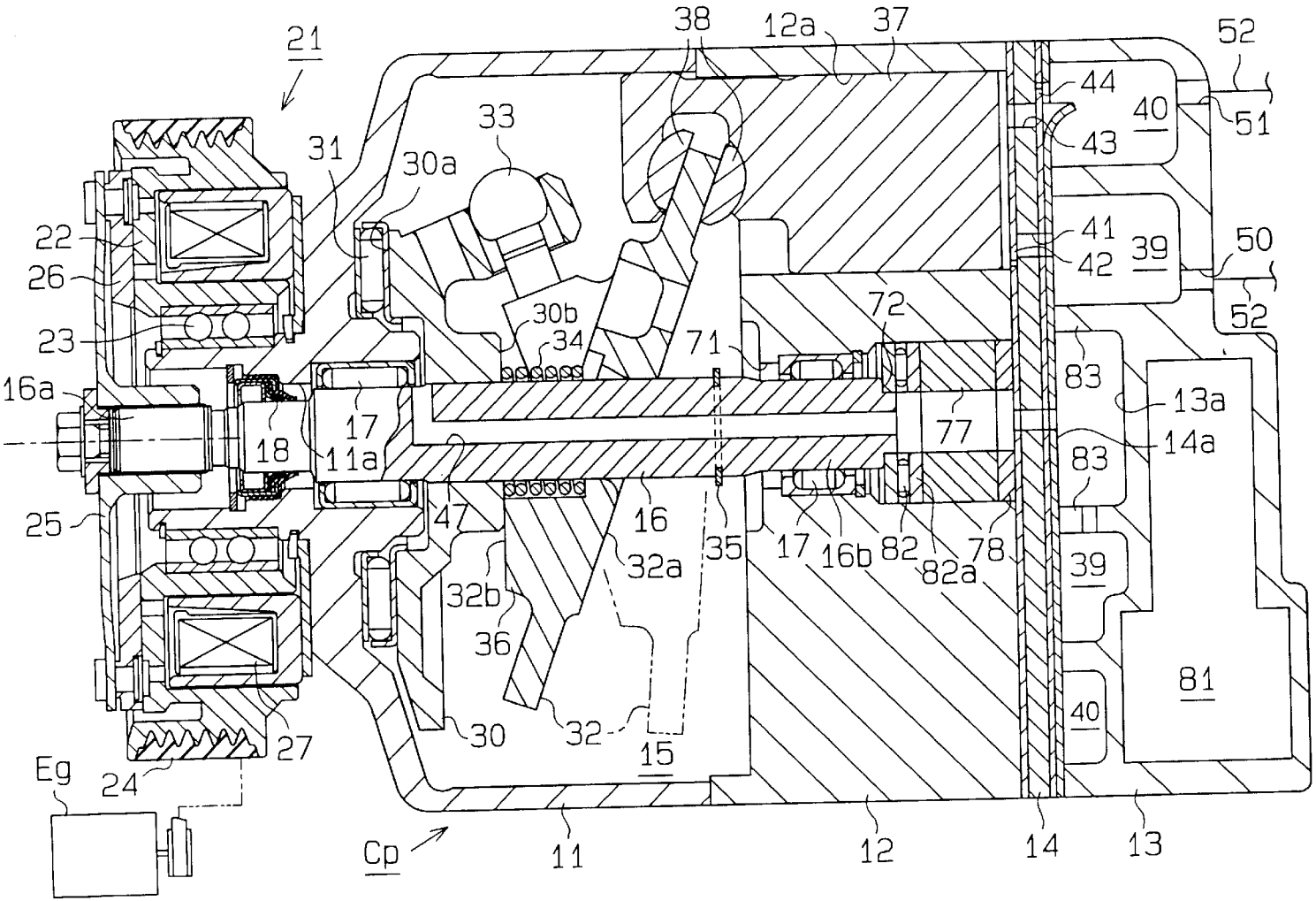
FIG. 5 is a cross-sectional view illustrating a variable displacement compressor according to a second embodiment of the present invention.

FIG. 5 illustrates a compressor Cp according to the second embodiment. The compressor Cp of FIG. 5 is different from the compressor Cp of FIGS. 1 to 4 in the arrangement of the suction and discharge chambers. Specifically, the compressor Cp of FIG. 5 has an annular suction chamber 39 and an annular discharge chamber 40 located about the suction chamber 39. Also, the structure for supporting the rear portion 16*b* of the drive shaft 16 and the control valve are different from those of the compressor Cp of FIGS. 1 to 4.

The discharge chamber 40 is formed in a peripheral portion of the rear housing 13 and the suction chamber 39 is located inside the discharge chamber 40.

A thrust bearing 82 is fitted to the step 72 formed on the rear portion 16*b* of the drive shaft 16. The spacer 77 and the adjuster shim 78 are fitted between a rear race 82*a* of the bearing 82 and the valve plate 14.

An annular support wall 83 projects from the center of a central wall 13*a* of the rear housing 13. The support wall 83 contacts the rear surface 14*a* of the valve plate 14. The support wall 83 corresponds to the part of the valve plate 14 that is immediately surrounding the shim 78. In other words, the contact area between the valve plate 14 and the support wall 83 serves as a fulcrum and the contact area between the shim 78 and the valve plate 14 is a ring along which the rearward thrust load from the shaft 16 is applied. The fulcrum is located outside of and is separated by a constant distance from the ring of load application.

When assembling the compressor Cp, the shim 78 is selected from shims having different axial dimensions such that the part of the valve plate 14 surrounded by the support wall 83 is rearwardly deformed by a predetermined amount. In this case, the valve plate 14 functions as a leaf spring and applies a predetermined load on the shim 78. The rear thrust bearing 82, the spacer 77 and the shim 78 form a transmitter that transmits the thrust load acting on the drive shaft 16 to the valve plate 14.

As in the embodiment of FIGS. 1 to 4, when assembling the compressor Cp, the initial load applied by the valve plate 14 can be adjusted by choosing the shim 78 among shims having different axial dimensions. The initial load of the valve plate 14 compensates for dimensional errors of parts and prevents the drive shaft 16 from being axially displaced by a significant amount. The initial deformation of the valve plate 14 urges the drive shaft 16 forward. Therefore, when the clutch 21 is not activated, a sufficient space exists between the armature 26 and the pulley 22.

The compressor Cp of FIG. 5 includes a control valve 81, which is actuated electromagnetically, like the control valve 49 of FIG. 1. The control valve 81 is also actuated by changes of suction pressure Ps of the suction chamber 39. That is, the control valve 81 has a valve hole 87, the opening of which is adjusted by a valve body 86 based on the pressure Ps in the suction chamber 39. Specifically, a valve chamber 88 is defined in the center of the control valve 81 to accommodate the valve body 86. The valve hole 87 extends along the axis of the control valve 81. An opening of the valve hole 87 is formed to face the valve body 86. The valve body 86 is urged by a spring 89 in a direction opening the valve hole 87. The valve chamber 88 is connected to the discharge chamber 40 by a valve chamber port 88*a* and the supply passage 48.

A pressure sensing chamber 90 is defined in the upper portion of the control valve 81. The pressure sensing chamber 90 is connected to the suction chamber 39 by a pressure sensing port 90*a* and a pressure introduction passage 91. A bellows 92 is accommodated in the pressure sensing chamber 90. The bellows 92 is actuated in accordance with the pressure Ps in the suction chamber 39. The bellows 92 is coupled to the valve body 86 through a rod 93. The distance between the bellows 92 and the valve body 86 is variable.

A port 94 is formed perpendicular to the valve hole 87 between the valve chamber 88 and the pressure sensing chamber 90. The middle portion of the valve hole 87 is communicated with the port 94. The port 94 is connected to the crank chamber 15 by the supply passage 48.

An electromagnetic actuator 63 is located at the bottom of the control valve 81. A plunger 66 is coupled to a valve body 86 by a rod 95. As in the compressor Cp of FIGS. 1 to 4, a coil 64 is located radially outward of both the fixed core 65 and the plunger 66. The coil 64 is connected to a driver 62. The driver 62 supplies current to the coil 64 in accordance with command signals from the computer 56.

As described above, the control valve 81 is actuated not only by the electromagnetic structure but also by the pressure sensing mechanism. The length of the bellows 92 varies in accordance with the suction pressure Ps that is introduced to the pressure sensing chamber 90 through the pressure introduction passage 91. Changes in the length of the bellows 92 are transmitted to the valve body 86 by the rod 93. The opening size of the valve hole 87 is determined by the equilibrium position of the valve body 86, which is affected by the force of the actuator 63, the force of the bellows 92 and the force of the spring 89.

When the need for cooling the passenger compartment and the thermal load of the evaporator 55 are great, the temperature in the passenger compartment detected by the sensor 58 is higher than a target temperature set by the temperature adjuster 61. The computer 56 controls the current value to the actuator 62 based on the difference between the detected temperature and the target temperature thereby changing a target value of the suction pressure Ps. Particularly, the computer 56 commands the driver 62 to increase the magnitude of the current sent to the coil 64 as the passenger compartment temperature increases. A higher current magnitude increases the attractive force between the fixed core 65 and the plunger 66 thereby increasing the resultant force that causes the valve body 86 to close the valve hole 87. Therefore, opening the valve 81 requires a lower suction pressure Ps. Thus, increasing the current value to the actuator 62 causes the valve 81 to maintain a lower suction pressure Ps.

When need for cooling the passenger compartment and the thermal load of the evaporator 55 are small, the temperature in the passenger compartment detected by the sensor 61 is not significantly higher than a target temperature set by the temperature adjuster 61. In this state, the computer 56 commands the driver 62 to decrease the magnitude of the current sent to the coil 64. A lower current magnitude decreases the attractive force between the fixed core 65 and the plunger 66 and thus decreases the resultant force that moves the valve body 86 in a direction closing the valve hole 87. As a result, the valve 81 operates at a higher suction pressure Ps. Thus, if the current value to the coil 64 is lowered, the valve 81 maintains a higher suction pressure Ps.

As described above, the valve 81 is controlled in accordance with the magnitude of the current supplied to the coil 64 of the actuator 63. When the magnitude of the current is increased, the valve 81 opens the valve hole 87 at a lower suction pressure Ps. When the magnitude of the current is decreased, on the other hand, the valve 81 opens the valve hole 87 at a higher suction pressure Ps. In this manner, the target value of the suction pressure Ps is changed in accordance with the magnitude of the current supplied to the coil 64. The inclination of the swash plate 32 is changed to maintain the target suction pressure Ps. Accordingly, the displacement of the compressor Cp is varied.

That is, the valve 81 changes the target value of the suction pressure Ps in accordance with the value of the current supplied thereto. Also, the valve 81 can cause the compressor to operate at the minimum displacement for any given suction pressure Ps. The compressor Cp, which is equipped with the control valve 81, varies the cooling ability of the external refrigerant circuit 52.

Figure 6:
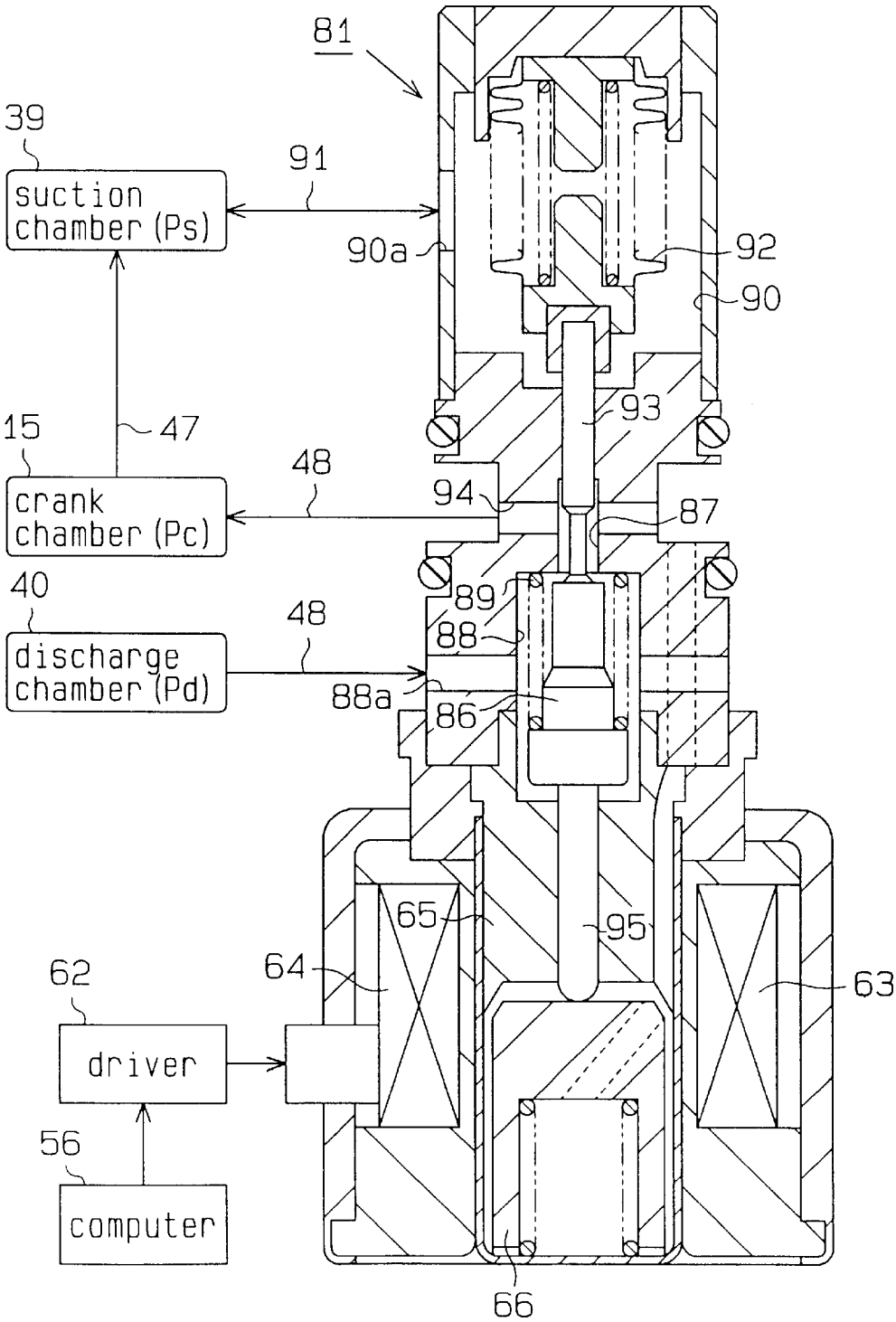
FIG. 6 is an enlarged partial cross-sectional view showing a control valve in the compressor of FIG. 5.

The compressor of FIGS. 5 and 6 has substantially the same structure as the compressor of FIGS. 1 to 4. Specifically, the valve plate 14 of the compressor of FIGS. 5 and 6 has the same function as the conical leaf springs 76 of FIGS. 1 to 4, and the thrust bearing 82 has the same function as the angular bearing 73 of FIGS. 1 to 4. The compressor of FIGS. 5 and 6 therefore has the same advantages (A) to (D) as the compressor of FIGS. 1 to 4. Further, the compressor of FIGS. 5 and 6 has the following advantages.

(E) The rearward thrust load acting on the drive shaft 16 is transmitted to the valve plate 14 through the rear thrust bearing 82, the spacer 77 and the shim 78. The valve plate 14 is arranged such that it has an initial deformation. The valve plate 14 therefore functions as a leaf spring to prevent the drive shaft 16 from moving in the axially rearward direction.

Thus, significant rearward displacement of the drive shaft 16 is prevented by the valve plate 14, which is a basic component of the compressor Cp, without increasing the number of parts. Compared to the compressor of FIGS. 1 to 4, the compressor Cp of FIGS. 5 and 6 does not require the spacer ring 74, the conical leaf springs 76 and the snap ring 75, which simplifies the structure. That is, the structure supporting the rear portion 16*b* of the drive shaft 16 is simplified. Therefore, the construction of the compressor housing is simplified and easy to manufacture.

(F) The contact area between the valve plate 14 and the support wall 83, which functions as a fulcrum, is radially outside the contact area between the shim 78 and the valve plate 14, which functions as a load application ring, by a predetermined distance.

The structure allows the valve plate 14 to apply a sufficient load when the valve plate 14 receives a rearward thrust load. Further, the relationship between the deformation amount of the valve plate 14 and the magnitude of reaction force can be adjusted by changing the distance between the fulcrum area and the load application area.

A third embodiment of the present invention will hereafter be described. The differences from the embodiments of FIGS. 1 to 6 will mainly be discussed below.

Figure 7:
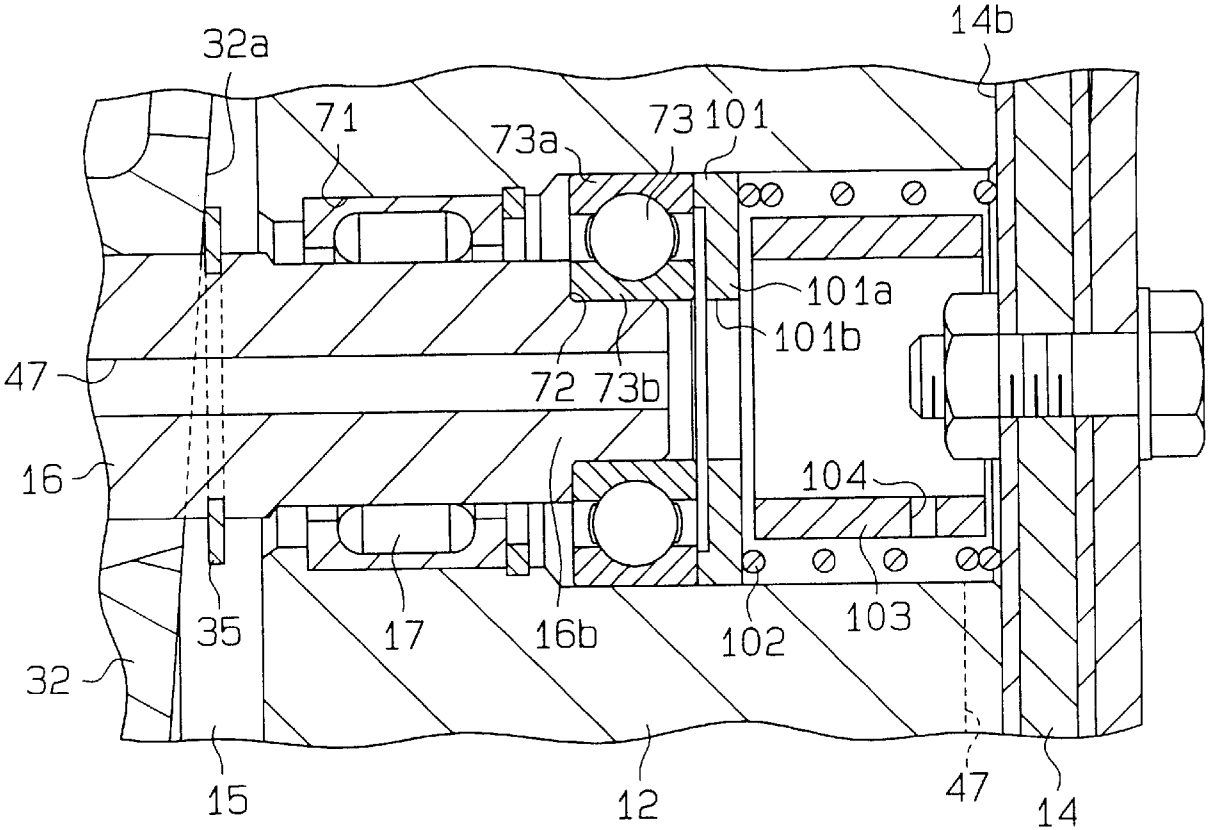
FIG. 7 is an enlarged partial cross-sectional view showing a variable displacement compressor according to a third embodiment of the present invention.

As shown in FIG. 7, the compressor of the third embodiment has a different structure for supporting the rear portion 16*b* of the drive shaft 16 from that of the compressor of FIGS. 1 to 4.

That is, a guide 101 is located adjacent to the outer race 73*a* of the angular bearing 73. A hole 101*b* is formed in the center of a disk portion 101*a* of the guide 101, which permits gas flow in the bleeding passage 47.

A coil spring 102 extends between the guide disk portion 101*a* and the front surface 14*b* of the valve plate 14. The coil spring 102 is installed in an axially compressed state and therefore generates an initial load. That is, the coil spring 102 urges the drive shaft 16 forward through the guide 101 and the angular bearing 73.

A cylindrical stopper 103 made of a rigid material is located within the coil spring 102. The coil spring 102 and the stopper 103 are coaxial.

The length of the stopper 103 is selected such that the stopper 103 is spaced apart from the outer race 73*a* of the angular bearing 73 and from the front surface 14*b* of the valve plate 14 by predetermined distances. The total axial length of the spaces is less than the distance between each piston 37 and the valve plate 14 when the piston 37 is at the top dead center. The spaces are exaggerated in FIG. 7 but are actually very narrow.

When the swash plate 32 is pressed against the stop ring 35 and applies a rearward thrust load to the drive shaft 16, the coil spring 102 is compressed, which allows the drive shaft 16 to move rearward slightly. Then, the stopper 103 contacts the disk portion 101*a* of the guide 101 and the front surface 14*b* of the valve plate 14, which restrict further rearward movement of the drive shaft. In this manner, the stopper 103 limits the maximum rearward deformation of the coil spring 102.

A hole 104 is formed in the stopper 103 to communicate the interior of the stopper 103 with the outside when the stopper 103 contacts both the guide 101 and the valve plate 14. That is, the hole 104 guarantees gas flow in the bleeding passage 47.

Therefore, the embodiment of FIG. 7 has the following advantages in addition to the advantages (B) and (C) of the embodiment of FIGS. 1 to 4.

(G) The coil spring 102 and the stopper 103 are located between the rear portion 16*b* of the drive shaft 16 and the valve plate 14.

Thus, if the drive shaft 16 receives a rearward thrust load, the drive shaft 16 is moved rearward by the distance equivalent to the axial dimension of the small spaces between the stopper 103 and the guide 101 and the valve plate 14. However, further rearward axial movement is prevented. Therefore, when receiving a rearward thrust load, the drive shaft 16 is not moved rearward by a significant amount.

The total length of the spaces next to the stopper 103, or the maximum deformation amount of the coil spring 102, is smaller than the distance between the pistons 37 and the valve plate 14 at the top dead center position. Therefore, if the drive shaft 16 moves axially rearward thus altering the stroke range of the pistons 37, the pistons 37 nevertheless do not contact the valve plate 14. Thus, noise and vibration of the compressor Cp are suppressed. Also, parts including the valve plate 14 are not damaged, which extends the life of the compressor Cp.

Since the drive shaft 16 is not significantly moved axially, the lip seal 18 is not moved relative to the drive shaft 16 and is not moved significantly away from the contact area. Therefore, premature deterioration of the lip seal 18 and gas leakage are prevented, which extends the life of the compressor Cp.

As shown in FIG. 4, the force of the coil spring 102 varies with respect to displacement by a smaller amount compared to a conical leaf spring. Thus, the initial load of the coil spring 102 does not have to be finely controlled as in the case of conical leaf springs, which facilitates the setting of the initial load of the coil spring 102.

If the drive shaft 16 is made of iron and the cylinder block 12 is made of aluminum, the drive shaft 16 and the cylinder block 12 have different coefficients of thermal expansion. That is, when the compressor Cp operates, the drive shaft 16 and the cylinder block 12 are expanded by different rates, which will change the compression amount of the coil spring 102. As described above, the coil spring 102 changes its force by a small amount when its compression amount is changed. Therefore, even if the drive shaft 16 and the cylinder block 12 are expanded by different rates, the force of the coil spring: 102 scarcely changes.

(H) The stopper 103, which has a predetermined length, is located within the coil spring 102 to prevent the drive shaft 16 from being moved axially by a significant amount. In this manner, significant rearward movement of the drive shaft 16 is prevented by a simple structure, which reduces the manufacturing cost.

A fourth embodiment of the present invention will hereafter be described. The differences from the embodiments of FIGS. 1 to 7 will mainly be discussed below.

Figure 8:
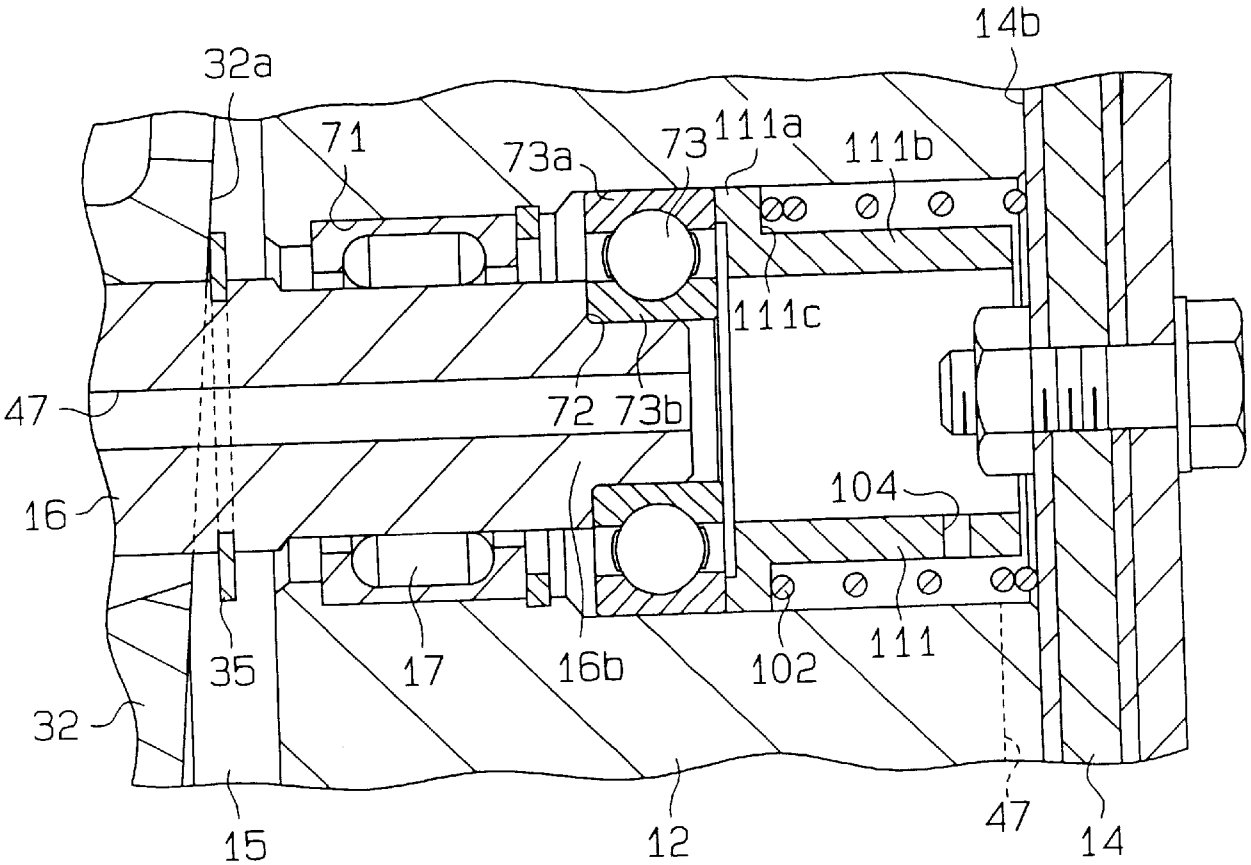
FIG. 8 is an enlarged partial cross-sectional view showing a variable displacement compressor according to a fourth embodiment of the present invention.

As shown in FIG. 8, the compressor of the fourth embodiment includes a stopper 111, which is formed by combining the guide 101 and the stopper 103 of the embodiment of FIG. 7. The stopper 111 includes a large diameter portion 111*a* and a small diameter portion 111*b*, which form a step 111*c* in between. A coil spring 102 is installed between the step 111*c* and the front surface 14*b* of the valve plate 14*b* in an axially compressed state.

The stopper 111 is urged by the coil spring 102 against the outer race 73*a* of the angular bearing 73. As in the embodiment of FIG. 7, a space exists between the stopper 111 and the front surface 14*b* of the valve plate 14.

Therefore, the embodiment of FIG. 8 has substantially the same advantages as the embodiment of FIG. 7. In addition, the embodiment of FIG. 8 has the following advantage.

(I) The stopper 111 includes an integrated guide and stopper, which reduces the number of parts.

A fifth embodiment of the present invention will hereafter be described. The differences from the embodiments of FIGS. 1 to 8 will mainly be discussed below.

Figure 9:
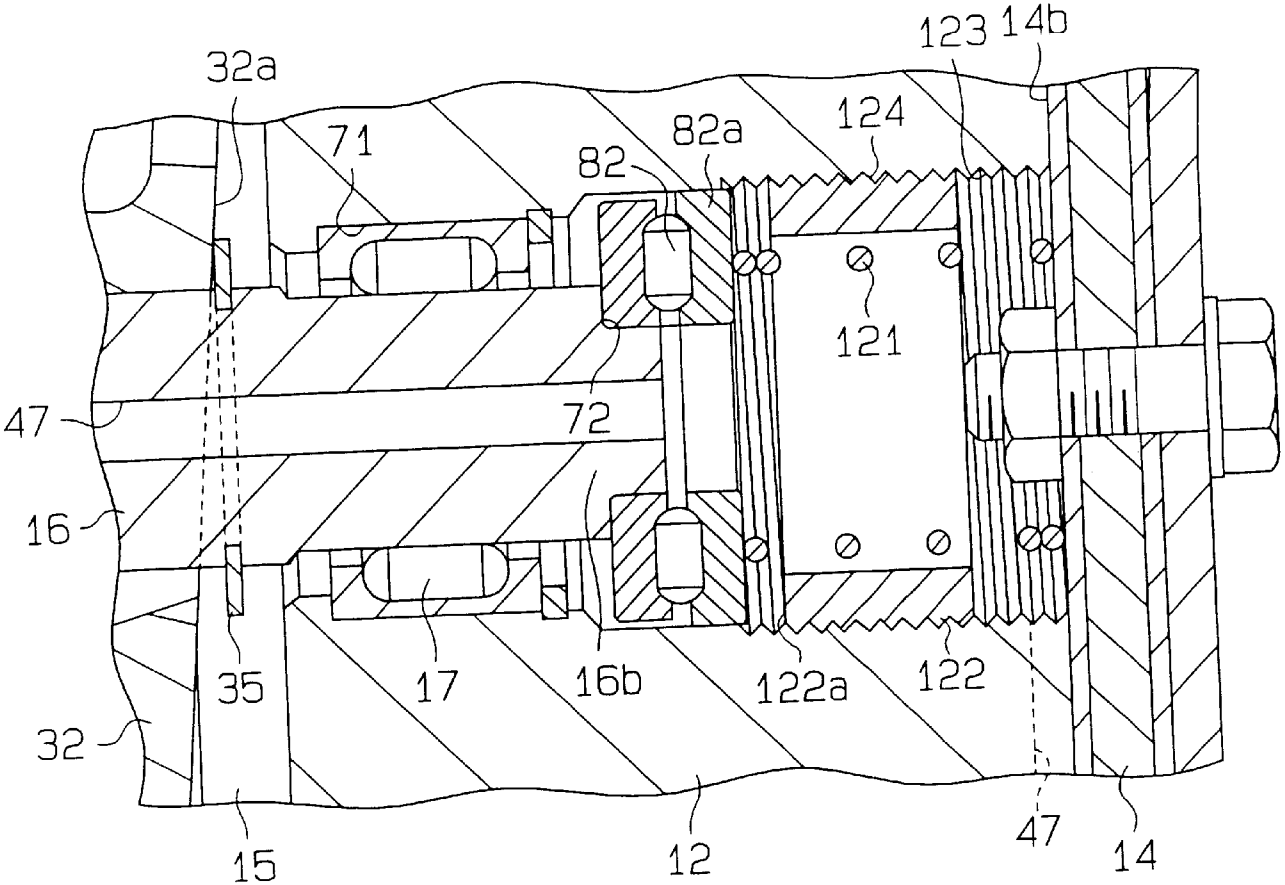
FIG. 9 is an enlarged partial cross-sectional view showing a variable displacement compressor according to a fifth embodiment of the present invention.
Figure 10:
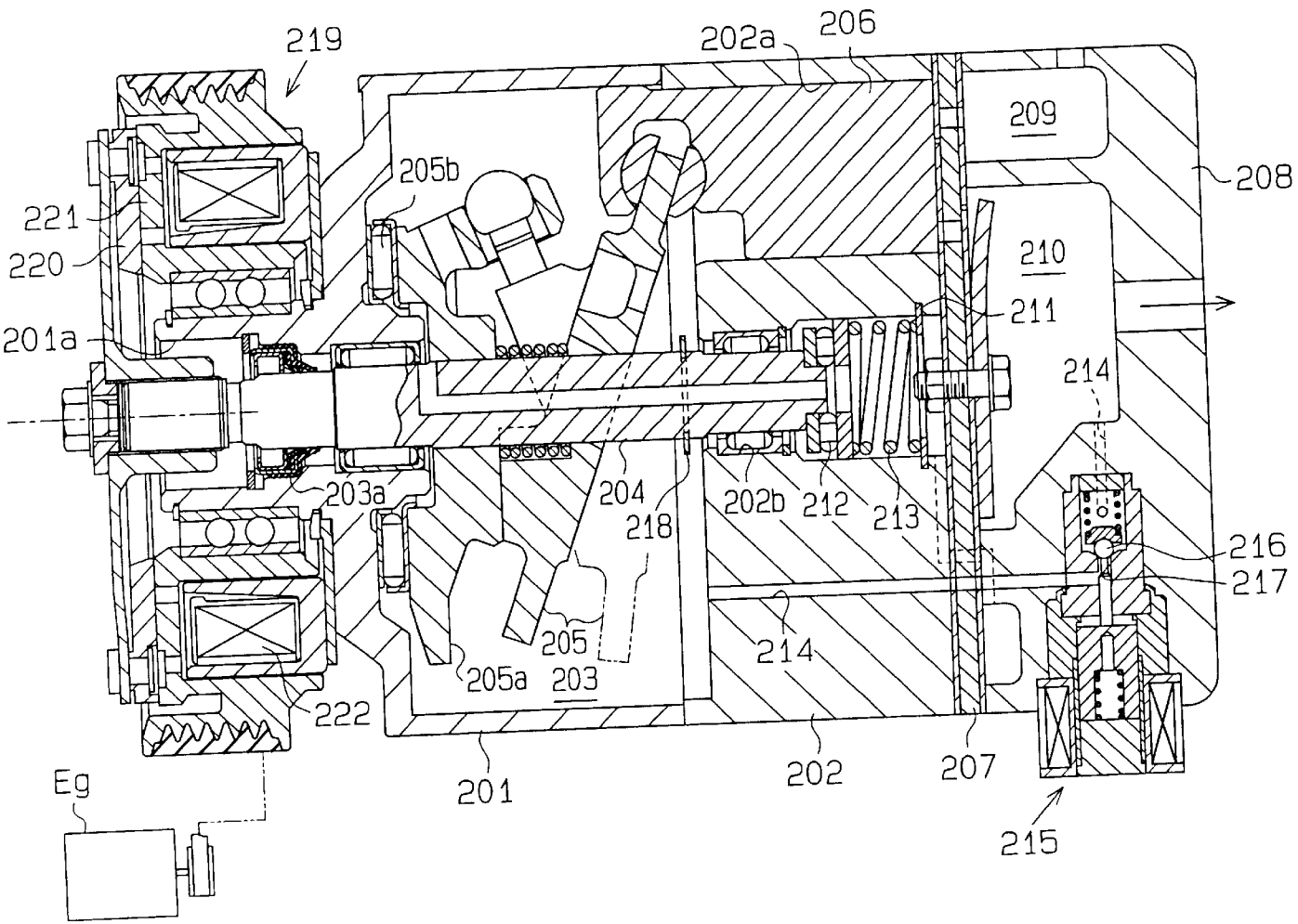
Fig.10 (Prior Art)
FIG. 10 is a cross-sectional view illustrating a prior art compressor.

As illustrated in FIG. 9, the compressor of the fifth embodiment includes a rear thrust bearing 82 comprising a needle bearing at the rear portion 16*b* of the drive shaft 16. The compressor of FIG. 9 is different from the compressor of FIG. 7 in that a stopper 122 is located about a coil spring 121 and that the stopper 122 has a setting member for adjustably setting the maximum compression amount of the coil spring 121.

The coil spring 121 of FIG. 9 has a smaller diameter than the coil springs 102 of FIGS. 7 and 8. The coil spring 121 is located between the rear race 82*a* of the thrust bearing 82 and the front surface 14*b* of the valve plate 14.

A threaded hole 123 is formed coaxial to and rearward of the axial bore 71. The stopper 122 is threaded to the threaded hole 123. The maximum compression amount of the coil spring 121 is adjusted by changing the axial position of the stopper 122 in the threaded hole 123. The adjuster is formed by the threaded hole 123 and the threaded portion 124 of the stopper 122.

The maximum compression amount of the coil spring 121 is adjusted, for example, in the following manner. First, the stopper 122 is threaded into the threaded hole 123 until the front surface 122*a* of the stopper 122 contacts the rear race 82*a*. Then, the stopper 122 is moved rearward by a distance less than the distance between the front surface of the pistons 37 and the valve plate 14 when the pistons 37 are at the top dead center position. The stopper 122 is deformed at several parts to fix it to the cylinder block 12. In this manner, the maximum compression amount of the coil spring 121 is adjusted.

In addition to the advantages of the compressor of FIG. 7, the compressor of FIG. 9 has the following advantage.

(J) The threaded hole 123 is formed in the shaft hole 71 of the cylinder block 12 and the threaded portion 124 is formed on the stopper 122. This allows the maximum compression amount of the coil spring 121 to be adjusted.

Therefore, the stopper 122 does not need to be selected from various stoppers having-different axial dimensions to determine the maximum compression amount of the coil spring 121. Accordingly, the range of parts inventory is reduced, which lowers the manufacturing cost of the compressor Cp.

It should be apparent to those skilled in the art that the present invention may be embodied in many other specific forms without departing from the spirit or scope of the invention. Particularly, it should be understood that the invention may be embodied in the following forms.

The orientation of the conical leaf springs 76 of FIG. 2 may be opposite to that illustrated. Alternatively, the orientation of the conical leaf spring 76 that is located next to the angular bearing 3 may be opposite to that illustrated. This allows the spacer ring 74 to be omitted thus facilitating the manufacturing.

The number of the conical leaf springs 76 of FIG. 2 may be changed. That is, the number of the conical leaf springs 76 may be one, two or more than three. Alternatively, the conical leaf springs 76 may be replaced with conical leaf springs having different axial dimensions. This allows the relationship between the deformation amount of the conical leaf springs 76 and the corresponding force of the springs 76 to be adjusted.

In the embodiment of FIGS. 1 to 4, the spacer ring 74 and the conical leaf springs 76 may be located between the spacer 77 and the shim 78 or between the shim 78 and the snap ring 75. This structure has the same advantages as those of the compressor of FIGS. 1 to 4.

In the embodiment of FIGS. 1 to 4, the snap ring 76 may be omitted and the shim 78 may directly contact the valve plate 14. This structure reduces the number of parts.

In the embodiment of FIGS. 5 and 6, the thrust bearing 82 may be replaced with the angular bearing 73. In this case, the ring 74, the conical leaf springs 76 and the snap ring 75 can be omitted from the construction of the embodiment of FIGS. 1 to 4, which reduces the number of parts.

In the embodiment of FIGS. 5 and 6, the support wall 83 may be replaced with number of arcuate projections. This structure reduces the weight of the rear housing 13 and the compressor Cp.

In the embodiment of FIG. 7, the stopper 103 may be integrally formed with the valve plate 14. In this case, the space behind the stopper 103 is eliminated.

In the embodiment of FIG. 9, the threaded hole 123 and the threaded portion 124 may be omitted, and the stopper 122 may be selected from stoppers having different axial dimensions so that the predetermined space exists next to the stopper 122.

In the illustrated embodiments, the axial arrangement of the pulley 22 and the armature 26 may be reversed.

This structure prevents the rearward displacement of the drive shaft 16. Therefore, when the core 27 is excited, the attractive force between the pulley 22 and the armature 26 is not weakened. Thus, when the compressor displacement is minimum and the swash plate 32 is pressed against the stop ring 35 when the clutch 21 is activated, the pulley 22 and the armature 26 are prevented from sliding against each other. Accordingly, noise and heat at the clutch 21 are prevented, which improves the compression efficiency of the compressor.

The rear support structures of the drive shaft 16 according to the above embodiments may be embodied in a wobble plate type variable displacement compressor.

The present examples and embodiments are to be considered as illustrative and not restrictive and the invention is not to be limited to the details given herein, but may be modified within the scope and equivalence of the appended claims.

What is claimed is:

1. A variable displacement compressor comprising:

a crank chamber;

a drive shaft rotatably supported by and extending through the crank chamber;

a cam plate supported by the drive shaft in the crank chamber, wherein the inclination of the cam plate is changeable;

a piston coupled to the cam plate, wherein the piston is reciprocated by a stroke in accordance with the inclination of the cam plate;

a valve plate located at the opposite side of the piston from the crank chamber;

a control valve for controlling the difference between the pressure in the crank chamber and the pressure at the valve plate, which act on the piston, thereby changing the inclination of the cam plate to control the displacement of the compressor;

a limit member attached to the drive shaft, wherein the limit member is located next to the cam plate, and wherein the limit member defines the minimum inclination of the cam plate; and a stopper for preventing the drive shaft from moving toward the valve plate by a significant amount when the cam plate contacts the limit member, the stopper including the valve plate and rigid material lying between the valve plate and the drive shaft;

wherein the drive shaft can move axially rearward by a predetermined distance when the cam plate contacts and presses against the limit member thereby applying a rearward thrust load to the drive shaft, and further rearward movement of the drive shaft exceeding the predetermined distance is prevented by the rigid material.

2. The compressor according to claim 1, wherein the rigid material is a transmitter for transmitting a thrust load pressing the drive shaft toward the valve plate to the valve plate, wherein the valve plate functions as a leaf spring.

3. The compressor according to claim 2, further including an adjuster for adjusting a preload applied to the valve plate.

4. The compressor according to claim 2, further including a support wall located on the opposite side of the valve plate from the transmitter, wherein the radial location of the support wall is outside of the location of contact between the transmitter and the valve plate, and wherein the support wall receives the thrust load directed toward the valve plate.

5. The compressor according to claim 1, wherein a coil spring is provided to act against the thrust load pressing is the drive shaft toward the valve plate, wherein the stopper limits the maximum compression amount of the coil spring.

6. The compressor according to claim 5, wherein the rigid material of the stopper is coaxial to the coil spring.

7. The compressor according to claim 5, wherein the stopper includes a setting member for adjustably setting the maximum compression amount of the coil spring.

8. The compressor according to claim 5, wherein the rigid material of the stopper is cylindrical and is coaxial to the coil spring, wherein the outer surface of the rigid material is threaded.

9. The compressor according to claim 1, wherein the stopper further comprises an elastic member and the drive shaft is axially movable by the compression amount of the elastic member.

10. The compressor according to claim 1, wherein the control valve is provided in the supply passage.

11. A variable displacement compressor comprising:

a crank chamber for storing compressed gas;

a drive shaft rotatably supported by and extending through the crank chamber between a front portion and a rear portion of the compressor;

a cam plate supported by the drive shaft in the crank chamber, the cam plate rotating integrally with the drive shaft, wherein the inclination of the cam plate is changed in accordance with the pressure in the crank chamber;

a piston located at the rear side of the cam plate, the piston being coupled to the cam plate, wherein the piston is reciprocated by rotation of the cam plate by a stroke in accordance with the inclination of the cam plate, wherein the stroke is a distance measured between top dead center and bottom dead center positions of the piston;

a valve plate located at the rear side of the piston, wherein the valve plate is spaced apart from the piston by a predetermined distance when the piston occupies the top dead center position;

a control valve for controlling the pressure in the crank chamber thereby changing the inclination of the cam plate to control the displacement of the compressor;

a limit member attached to the drive shaft at the rear side of the cam plate, wherein the limit member defines the minimum inclination of the cam plate; and a stopper for preventing the drive shaft from moving rearward by more than the predetermined distance when the cam plate contacts the limit member, the stopper including the valve plate and rigid material lying between the valve plate and the drive shaft;

wherein the drive shaft can move axially rearward by a predetermined distance when the cam plate contacts and presses against the limit member thereby applying a rearward thrust load to the drive shaft, and further rearward movement of the drive shaft exceeding the predetermined distance is prevented by the rigid material.

12. The compressor according to claim 11, wherein the rigid material is a transmitter for transmitting a thrust load pressing the drive shaft toward the valve plate to the valve plate, wherein the valve plate functions as a leaf spring.

13. The compressor according to claim 11, wherein a coil spring is provided to act against the thrust load pressing the drive shaft toward the valve plate, wherein the stopper limits the maximum compression amount of the coil spring.

14. A variable displacement compressor having a front portion and a rear portion, the compressor comprising:

a housing, wherein a crank chamber, cylinder bore and a shaft bore are defined in the housing;

a drive shaft rotatably supported by the housing, the drive shaft extending through the crank chamber between the front portion and the rear portion of the compressor, wherein the rear end portion of the drive shaft is located within the shaft bore;

a cam plate supported by the drive shaft in the crank chamber, the cam plate rotating integrally with the drive shaft, wherein the inclination of the cam plate is changeable;

a piston located at the rear side of the cam plate, the piston being housed in the cylinder bore and coupled to the cam plate, wherein the piston is reciprocated by rotation of the cam plate by a stroke in accordance with the inclination of the cam plate, wherein the stroke is a distance measured between a top dead center and bottom dead center positions of the piston;

a valve plate located at the rear side of the piston, wherein the valve plate is spaced apart from the piston by a predetermined distance when the piston occupies the top dead center position;

a control valve for controlling the difference between the pressure in the crank chamber and the pressure in the cylinder bore, which act on the piston, thereby changing the inclination of the cam plate to control the displacement of the compressor;

a limit member attached to the drive shaft at the rear side of the cam plate, wherein the limit member defines the minimum inclination of the cam plate; and a stopper located in the axial bore rearward of the drive shaft, wherein the stopper prevents the drive shaft from moving rearward by more than the predetermined distance when the control valve causes the cam plate to contact the limit member, wherein the stopper includes the valve plate and rigid material lying between the valve plate and the drive shaft;

wherein the drive shaft can move axially rearward by a predetermined distance when the cam plate contacts and presses against the limit member thereby applying a rearward thrust load to the drive shaft, and further rearward movement of the drive shaft exceeding the predetermined distance is prevented by the rigid material.

15. The compressor according to claim 14, wherein the rigid material is a transmitter for transmitting a thrust load pressing the drive shaft axially rearward to the valve plate, wherein the valve plate functions as a leaf spring.

16. The compressor according to claim 15, further including a support wall, the support wall being fixed to the housing and located on the opposite side of the valve plate from the transmitter, wherein the radial location of the support wall is outside of the location of contact between the transmitter and the valve plate, and wherein the support wall receives the rearwardly directed thrust load.

17. The compressor according to claim 14, wherein a coil spring is provided to act against the rearwardly directed thrust load and the rigid material of the stopper is cylindrical and is coaxial to the coil spring, wherein the rigid material limits the maximum compression amount of the coil spring.

18. The compressor according to claim 17, wherein the outer surface of the rigid material is threaded and the shaft bore has cooperating inner threads.

19. A variable displacement compressor comprising:

a crank chamber;

a drive shaft rotatably supported by and extending through the crank chamber;

a cam plate supported by the drive shaft in the crank chamber, wherein the inclination of the cam plate is changeable;

a piston coupled to the cam plate, wherein the piston is reciprocated by a stroke in accordance with the inclination of the cam plate;

a valve plate located at the opposite side of the piston from the crank chamber;

a control valve for controlling the difference between the pressure in the crank chamber and the pressure at the valve plate, which act on the piston, thereby changing the inclination of the cam plate to control the displacement of the compressor;

a limit member attached to the drive shaft, wherein the limit member is located next to the cam plate, and wherein the limit member defines the minimum inclination of the cam plate;

a coil spring provided to act against the thrust load pressing the drive shaft toward the valve plate, the coil spring extending from the drive shaft to the front surface of the valve plate; and a stopper for preventing the drive shaft from moving toward the valve plate by a significant amount when the cam plate contacts the limit member, the stopper including rigid material lying between the valve plate and the drive shaft to limit the maximum compression amount of the coil spring;

wherein the drive shaft can move axially rearward by a predetermined distance when the cam plate contacts and presses against the limit member thereby applying a rearward thrust load to the drive shaft, which compresses the coil spring, and further rearward movement of the drive shaft exceeding the predetermined distance is prevented by the rigid material.

20. The compressor according to claim 19, wherein the rigid material of the stopper is coaxial to the coil spring.

21. The compressor according to claim 19, wherein the stopper includes a setting member for adjustably setting the maximum compression amount of the coil spring.

22. The compressor according to claim 19, wherein the rigid material of the stopper is cylindrical and is coaxial to the coil spring, wherein the outer surface of the rigid material is threaded.

23. The compressor according to claim 19, wherein the rigid material and the coil spring are axially located in parallel to each other.

* * * * *